US012163522B2

(12) United States Patent
Uemura

(10) Patent No.: US 12,163,522 B2
(45) Date of Patent: Dec. 10, 2024

(54) COMPRESSOR CONTAINING OIL SEPARATOR WITH MULTIPLE INTERNAL MUFFLER SPACES

(71) Applicant: DAIKIN INDUSTRIES, LTD., Osaka (JP)

(72) Inventor: Yoshiyuki Uemura, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/373,632

(22) Filed: Sep. 27, 2023

(65) Prior Publication Data

US 2024/0018961 A1 Jan. 18, 2024

Related U.S. Application Data

(63) Continuation of application No. PCT/JP2022/007164, filed on Feb. 22, 2022.

(30) Foreign Application Priority Data

Mar. 31, 2021 (JP) ..... 2021-060586

(51) Int. Cl.
*F04C 29/06* (2006.01)
*F04B 39/00* (2006.01)
(Continued)

(52) U.S. Cl.
CPC ..... *F04C 29/065* (2013.01); *F04B 39/0061* (2013.01); *F04C 29/06* (2013.01);
(Continued)

(58) Field of Classification Search
CPC ..... F04C 29/065; F04C 29/06; F04C 29/068; F04C 18/16; F04C 2240/80;
(Continued)

(56) References Cited

U.S. PATENT DOCUMENTS 6,148,631 A 11/2000 Watanabe et al.
2008/0314063 A1* 12/2008 Lifson ..... F25B 43/02 62/470
(Continued)

FOREIGN PATENT DOCUMENTS

CN 204113388 U * 1/2015
EP 0 768 465 A1 4/1997
(Continued)

OTHER PUBLICATIONS

International Preliminary Report of corresponding PCT Application No. PCT/JP2022/007164 dated Oct. 12, 2023.
(Continued)

*Primary Examiner* — Bryan M Lettman
*Assistant Examiner* — Paul W Thiede
(74) *Attorney, Agent, or Firm* — Global IP Counselors, LLP

(57) ABSTRACT

A compressor includes a compression mechanism, and a muffler structure disposed between a compression-chamber outlet of the compression mechanism and an inflow end of a discharge pipe. The muffler structure includes a first muffler portion and a second muffler portion connected in series such that a refrigerant gas repeats expansion and contraction.

12 Claims, 11 Drawing Sheets

(51) Int. Cl.
*F04C 18/16* (2006.01)
*F25B 1/047* (2006.01)
*F25B 43/02* (2006.01)

(52) U.S. Cl.
CPC ..... *F04C 29/068* (2013.01); *F04C 18/16* (2013.01); *F04C 2240/80* (2013.01); *F25B 1/047* (2013.01); *F25B 43/02* (2013.01); *F25B 2400/02* (2013.01); *F25B 2500/12* (2013.01)

(58) Field of Classification Search
CPC ..... F04B 39/0061; F25B 1/047; F25B 43/02; F25B 2400/02; F25B 2500/12
See application file for complete search history.

(56) References Cited

U.S. PATENT DOCUMENTS

| | | | | |
|---|---|---|---|---|
| 2014/0023542 | A1* | 1/2014 | Yamashita | F04C 18/0215 418/55.6 |
| 2015/0361981 | A1 | 12/2015 | Kawano | |

FOREIGN PATENT DOCUMENTS

| | | | | | |
|---|---|---|---|---|---|
| JP | 58-191391 | U | | 12/1983 | |
| JP | 2-56892 | U | | 4/1990 | |
| JP | 9-105393 | A | | 4/1997 | |
| JP | 11-325655 | A | | 11/1999 | |
| JP | 2001329981 | A | * | 11/2001 | F01C 21/10 |
| JP | 3731329 | B2 | * | 1/2006 | F04B 27/109 |
| JP | 2013-528741 | A | | 7/2013 | |
| JP | 2014-47703 | A | | 3/2014 | |
| JP | 2016-191358 | A | | 11/2016 | |
| JP | 2020-67037 | A | | 4/2020 | |
| JP | 2020-84906 | A | | 6/2020 | |

OTHER PUBLICATIONS

International Search Report of corresponding PCT Application No. PCT/JP2022/007164 dated Apr. 5, 2022.
European Search Report of corresponding EP Application No. 22 77 9655.4 dated Jul. 2, 2024.

* cited by examiner

COMPRESSOR CONTAINING OIL SEPARATOR WITH MULTIPLE INTERNAL MUFFLER SPACES

CROSS-REFERENCE TO RELATED APPLICATIONS

This is a continuation of International Application No. PCT/JP2022/007164 filed on Feb. 22, 2022, which claims priority to Japanese Patent Application No. 2021-060586, filed on Mar. 31, 2021. The entire disclosures of these applications are incorporated by reference herein.

BACKGROUND

Technical Field

The present disclosure relates to a compressor.

Background Art

Japanese Unexamined Patent Application Publication No. 2014-47703 discloses a muffling device configured to be attached to a compressor. The muffling device suppresses noise generated by pressure fluctuation in the flow of a discharged refrigerant gas.

SUMMARY

A first aspect of the present disclosure is a compressor including a compression mechanism, and a muffler structure disposed between a compression-chamber outlet of the compression mechanism and an inflow end of a discharge pipe. The muffler structure includes a first muffler portion and a second muffler portion connected in series such that a refrigerant gas repeats expansion and contraction.

BRIEF DESCRIPTION OF THE DRAWINGS

In FIG. 3, a cover portion in a state of being viewed from the front side is illustrated.

In FIG. 4A, the muffling chamber in a state of being viewed from the side of a bearing holder is illustrated.

In FIG. 4B, the muffling chamber in a state of being viewed from the side of a cover portion is illustrated.

In FIG. 5A, the muffling chamber in a state of being viewed from the side of a bearing holder is illustrated.

In FIG. 5B, the muffling chamber in a state of being viewed from the side of a cover portion is illustrated.

In FIG. 6A, the muffling chamber in a state of being viewed from the side of a bearing holder is illustrated.

In FIG. 6B, the muffling chamber in a state of being viewed from the side of a cover portion is illustrated.

In FIG. 7A, the muffling chamber in a state of being viewed from the side of a bearing holder is illustrated.

In FIG. 7B, the muffling chamber in a state of being viewed from the side of a cover portion is illustrated.

DETAILED DESCRIPTION OF EMBODIMENT(S)

Hereinafter, an embodiment of the present invention will be described with reference to the drawings. Note that the following embodiment is basically presented as a preferred example and is not intended to limit the present invention, applications thereof, or the range of use thereof. In addition, components in each of the embodiment, modifications, other examples, and the like described below may be combined together or partially replaced in a range in which the present invention can be implemented.

EMBODIMENT

Figure 1:
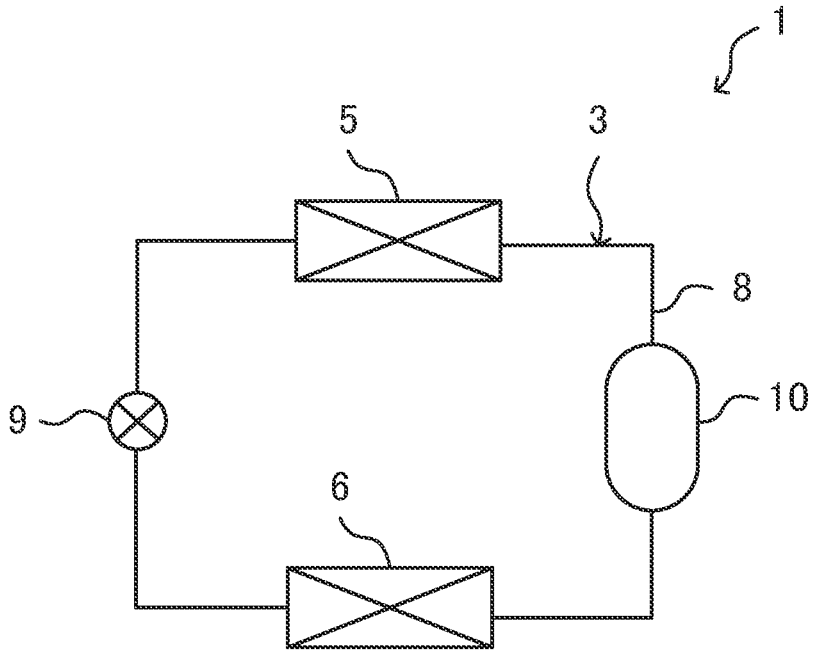
FIG. 1 is a schematic view of a refrigerant circuit of a refrigeration apparatus including a compressor according to an embodiment.

As illustrated in FIG. 1, a compressor (10) according to an embodiment is connected to a refrigerant circuit (3) of a refrigeration apparatus (1). For example, the compressor (10), a radiator (5), a decompression unit (9), and an evaporator (6) are connected in this order to the refrigerant circuit. A discharge pipe (8) through which a compressed refrigerant is discharged is provided between the compressor (10) and the radiator (5). In the refrigerant circuit, a vapor compression refrigeration cycle is performed. Specifically, a refrigerant compressed in the compressor (10) radiates heat in the radiator (5). The refrigerant that has radiated heat is decompressed in the decompression unit (9). The refrigerant decompressed in the decompression unit (9) evaporates in the evaporator (6). The refrigerant that has evaporated in the evaporator (6) is sucked into the compressor (10). The compressor (10) in this example includes an oil separator (30).

Compressor

Figure 2:
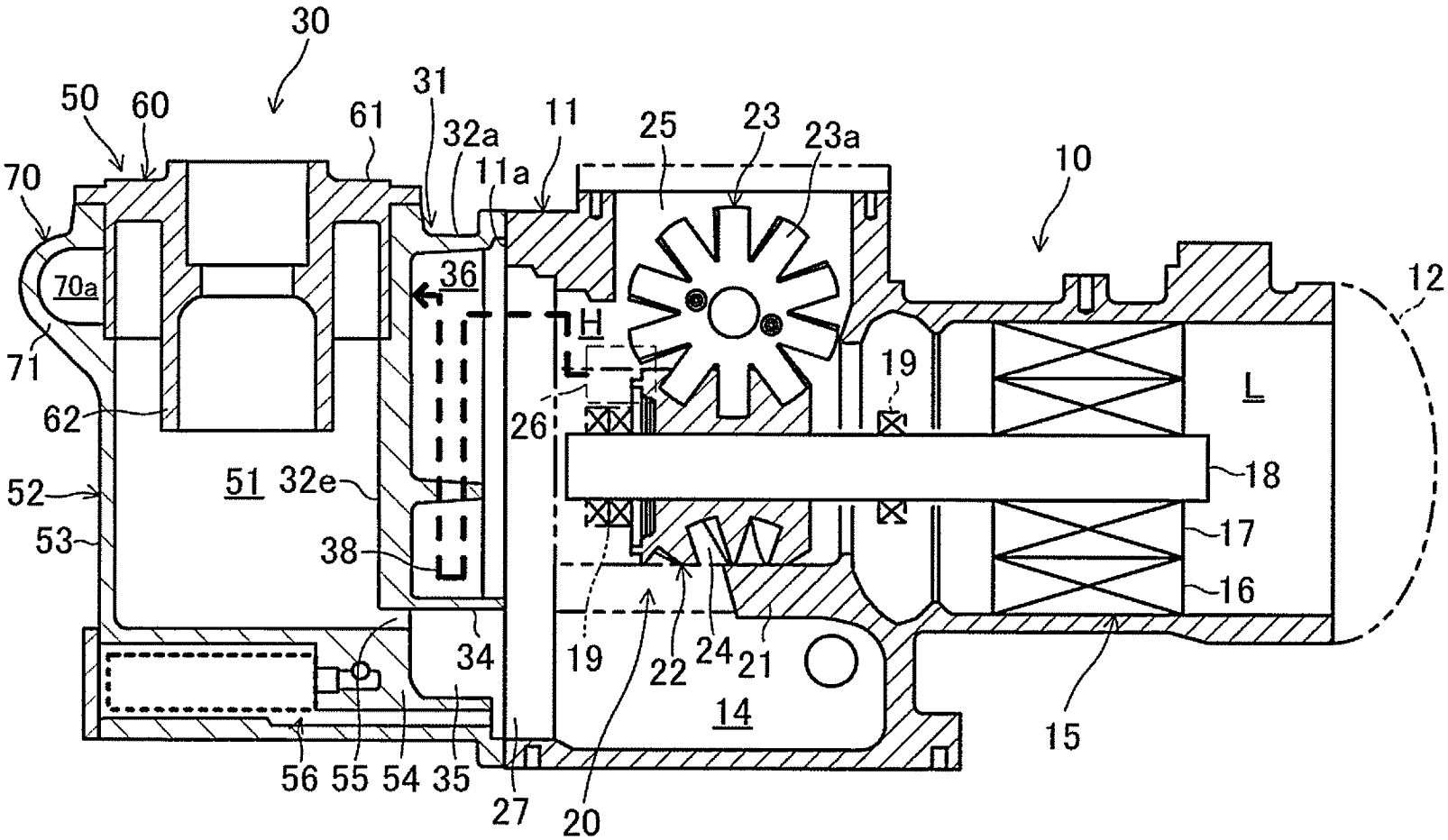
FIG. 2 is a longitudinal sectional view in which a general configuration of a compressor according to an embodiment is illustrated.

The compressor (10) compresses a refrigerant. The compressor (10) sucks a gas refrigerant having a low pressure and compresses the gas refrigerant. The compressor (10) discharges the compressed gas refrigerant having a high pressure. As illustrated in FIG. 2, the compressor (10) is a screw compressor. The compressor (10) is of a single screw type including a single screw rotor (22). The compressor (10) is of a single gate type including a single gate rotor (23). The compressor (10) includes a casing (11), an electric motor (15), a drive shaft (18), and a compression mechanism (20).

Casing

The casing (11) has a rectangular cylindrical shape. A low-pressure chamber (L) and a high-pressure chamber (H) are formed inside the casing (11). The low-pressure chamber (L) constitutes a flow path along which a low-pressure gas refrigerant to be sucked into the compression mechanism (20) flows. The high-pressure chamber (H) constitutes a flow path along which a high-pressure gas refrigerant discharged from the compression mechanism (20) flows.

A suction cover (12) is attached to one end of the casing (11) in the longitudinal direction. At the other end in the longitudinal direction, the casing (11) has an opening (11*a*). The opening (11*a*) is formed on the discharge side of the compressor (10). Specifically, the opening (11*a*) is provided, in the casing (11), on the high-pressure side where the high-pressure chamber (H) is formed. A cover portion (31) of the oil separator (30) is attached to the opening (11*a*). An oil chamber (14) that stores an oil is formed at a bottom portion inside the casing (11).

Electric Motor

The electric motor (15) is housed in the casing (11). The electric motor (15) includes a stator (16) and a rotor (17). The stator (16) is fixed to an inner wall of the casing (11). The rotor (17) is disposed inside the stator (16). The drive shaft (18) is fixed inside the rotor (17).

Drive Shaft

The drive shaft (18) couples the electric motor (15) and the compression mechanism (20) to each other. The drive shaft (18) extends in the longitudinal direction of the casing (11). The drive shaft (18) extends in a substantially horizontal direction. The drive shaft (18) is rotatably supported by a plurality of bearings (19). A shaft end of the drive shaft (18) on the opening side of the casing (11) is held by a bearing holder (27) disposed inside the casing (11). Specifically, the shaft end of the drive shaft (18) is held by the bearings (19) formed at the bearing holder (27). The bearing holder (27) is a plate portion in the present disclosure.

Compression Mechanism

The compression mechanism (20) includes a single cylinder portion (21), the single screw rotor (22), and the single gate rotor (23).

The cylinder portion (21) is formed inside the casing (11). The screw rotor (22) is disposed on the inner side of the cylinder portion (21). The screw rotor (22) is fixed to the drive shaft (18). A plurality (three in the present example) of spiral screw grooves (24) are formed on the outer peripheral surface of the screw rotor (22). The outer peripheral surface of the tooth tip of the screw rotor (22) is surrounded by the cylinder portion (21). One end side of the screw rotor (22) in the axial direction faces the low-pressure chamber (L). The other end side of the screw rotor (22) in the axial direction faces the high-pressure chamber (H).

The gate rotor (23) is housed in a gate rotor chamber (25). The gate rotor (23) includes a plurality of radially disposed gates (23*a*). The gates (23*a*) of the gate rotor (23) extend through a portion of the cylinder portion (21) and mesh with the screw grooves (24). A suction port, a compression chamber, and a discharge port (26) are formed in the compression mechanism (20). The suction port is a portion that opens, at the screw grooves (24), in the low-pressure chamber (L). The compression chamber is formed among the inner peripheral surface of the cylinder portion (21), the screw grooves (24), and the gates (23*a*).

The discharge port (26) is a portion that opens in the high-pressure chamber (H). In the compression mechanism (20), a refrigerant compressed in the compression chamber is discharged through the discharge port (26) into the high-pressure chamber (H). The discharge port (26) is formed on the other end side of the screw rotor (22) in the axial direction (refer to the dash and double-dot line in FIG. 1). The discharge port (26) is a compression-chamber outlet (26) of the compression mechanism (20) in the present disclosure. The discharge port (26) is in communication with an inflow end of the discharge pipe (8). A discharge flow path (38) along which a refrigerant gas flows is formed between the discharge port (26) and the inflow end of the discharge pipe (8).

The compression mechanism (20) includes a slide valve mechanism (not illustrated). The slide valve mechanism adjusts the timing of causing the compression chamber and the discharge port to be in communication with each other. The slide valve mechanism includes a slide member (slide valve) that moves forward and rearward in the axial direction of the drive shaft (18). A portion of the slide member is positioned in the high-pressure chamber (H).

Oil Separator

Figure 3:
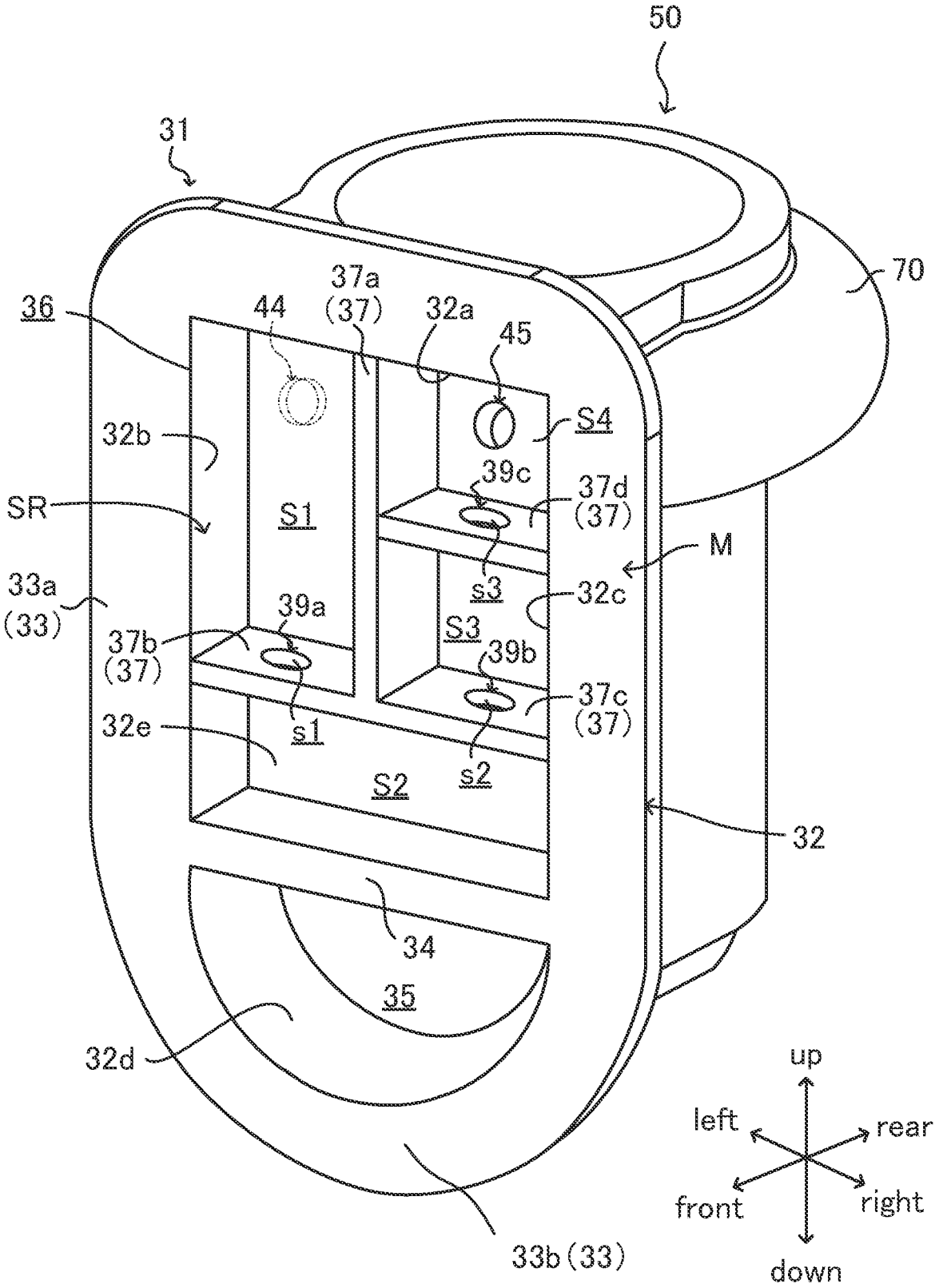
FIG. 3 is a three-dimensional perspective view of an oil separator.

The oil separator (30) is of a centrifugal separation type that separates an oil from a refrigerant by a centrifugal force. The oil separator (30) separates an oil from the inside of a refrigerant that is discharged from the compression mechanism (20). The oil separator (30) includes the cover portion (31), a cylindrical oil separator body (50), and a curved pipe (70). Hereinafter, FIG. 2 and FIG. 3 are referred for description. In the following description, phrases relating to 'up', 'down', 'right', 'left', 'front', and 'rear' are generally based on a case where the cover portion (31) illustrated in FIG. 3 is viewed from the front.

Cover Portion

The cover portion (31) is attached to the casing (11) so as to cover the opening (11*a*). The cover portion (31) covers the high-pressure chamber (H) of the compressor (10). The cover portion (31) forms a muffling chamber (SR), described later, between the cover portion (31) and the bearing holder (27). The cover portion (31) includes a cover body (32) and a flange portion (33).

The cover body (32) has a hollow shape (concave shape) that opens on the front side. The cover body (32) includes a right side wall (32*c*), a left side wall (32*b*), an upper wall (32*a*), (32*a*), a bottom wall (32*d*), and a back wall (32*e*). In front view, the bottom wall (32*d*) has a substantially semi-cylindrical shape that swells downward. The cover body (32) includes a partition wall (34). The partition wall (34) extends in the horizontal direction from the lower end of the right side wall (32*c*) to the lower end of the left side wall (32*b*). The partition wall (34) partitions the inside of the cover portion (31) into an oil reservoir space (35) and a discharge space (36).

The oil reservoir space (35) is a space demarcated by the partition wall (34) and the bottom wall (32*d*). As illustrated in FIG. 2, the oil reservoir space (35) is at a height position corresponding to the oil chamber (14) inside the casing (11). In the oil reservoir space (35), the oil separated in the oil separator (30) accumulates.

The discharge space (36) is a space formed by the bearing holder (27) that covers an opening on the front side of the cover body (32). Specifically, the discharge space (36) is formed by the partition wall (34), the left side wall (32*b*), the right side wall (32*c*), the upper wall (32*a*), the back wall (32*e*), and the bearing holder (27). The discharge space (36) is at a height position corresponding to the high-pressure chamber (H) inside the casing (11). A high-pressure gas refrigerant discharged from the compression mechanism (20) flows into the discharge space (36). The muffling chamber (SR), described later, is provided in the discharge space (36).

The flange portion (33) is provided at the front end of the cover body (32). The flange portion (33) has a vertically elongated frame shape. The flange portion (33) is fixed to the edge of the opening (11*a*) of the casing (11) with a fastening member interposed therebetween. The flange portion (33) includes a first flange portion (33*a*) and a second flange portion (33*b*). The first flange portion (33*a*) is connected to respective front ends of the upper wall (32*a*), the left side wall (32*b*), and the right side wall (32*c*). Thus, the first flange portion (33*a*) has an inverted U-shape in front view. The second flange portion (33*b*) is connected to the front end of the bottom wall (32*d*). Thus, the second flange portion (33*b*) has a U-shape in front view.

Oil Separator Body

The oil separator body (50) has a cylindrical shape. Strictly, the oil separator body (50) has a hollow cylindrical shape. A separation space (51) for separating an oil from the inside of a refrigerant by a centrifugal force is formed inside the oil separator body (50). A refrigerant that has flowed through the curved pipe (70) flows into the separation space (51). The oil separator body (50) includes an outer cylinder (52) and a cover member (60).

The outer cylinder (52) has a bottomed cylindrical shape that opens on the upper side. The outer cylinder (52) includes a cylindrical body portion (53) and a bottom portion (54) formed on the lower side of the body portion (53).

A front portion of the body portion (53) is integral with the cover portion (31). The body portion (53) has an oil outflow hole (55). The oil in the separation space (51) flows out through the oil outflow hole (55) into the oil reservoir space (35).

An oil-returning flow path (56) is formed at the bottom portion (54). The oil-returning flow path (56) is a flow path for supplying the oil in the oil reservoir space (35) to, for example, a predetermined lubrication portion of the compressor (10).

The cover member (60) is attached to an open portion of the outer cylinder (52) on the upper side. The cover member (60) includes an upper cover (61) and an inner cylinder (62).

The upper cover (61) has a substantially disk shape. The upper cover (61) is fixed to the upper end of the outer cylinder (52) with a fastening member interposed therebetween.

The inner cylinder (62) has a cylindrical shape that opens on the upper and lower sides. The inner cylinder (62) projects downward from the upper cover (61).

A space through which the separation space (51) and the discharge pipe (8) are in communication with each other is formed inside the inner cylinder (62). An opening at the upper end of the inner cylinder (62) is connected to the inflow end of the discharge pipe (8).

The curved pipe (70) introduces a high-pressure refrigerant containing an oil into the oil separator body (50). The curved pipe (70) is disposed to surround the body portion (53) of the oil separator body (50) in the circumferential direction. An internal flow path (70*a*) that curves along the curved pipe (70) is formed inside the curved pipe (70).

The inflow end of the curved pipe (70) is connected to an outflow port (45) formed in the discharge space (36). The outflow port (45) will be described later.

As described above, in the compressor (10) in the present example, the flow path extending from the discharge port (26) to the inflow end of the discharge pipe (8) forms the discharge flow path (38) along which the refrigerant compressed in the compression mechanism (20) flows.

Details of Muffler Structure

Figure 4A:
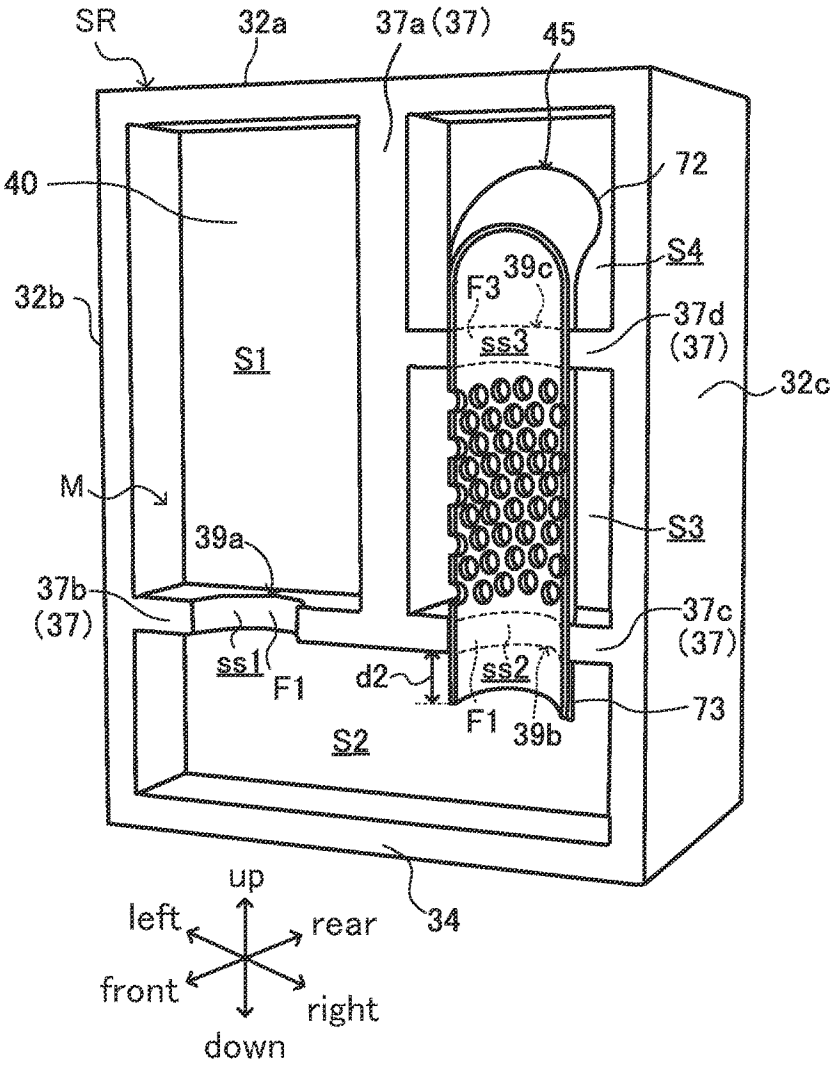
FIG. 4A is a three-dimensional perspective view in which a longitudinal section of a muffling chamber is illustrated.
Figure 4B:
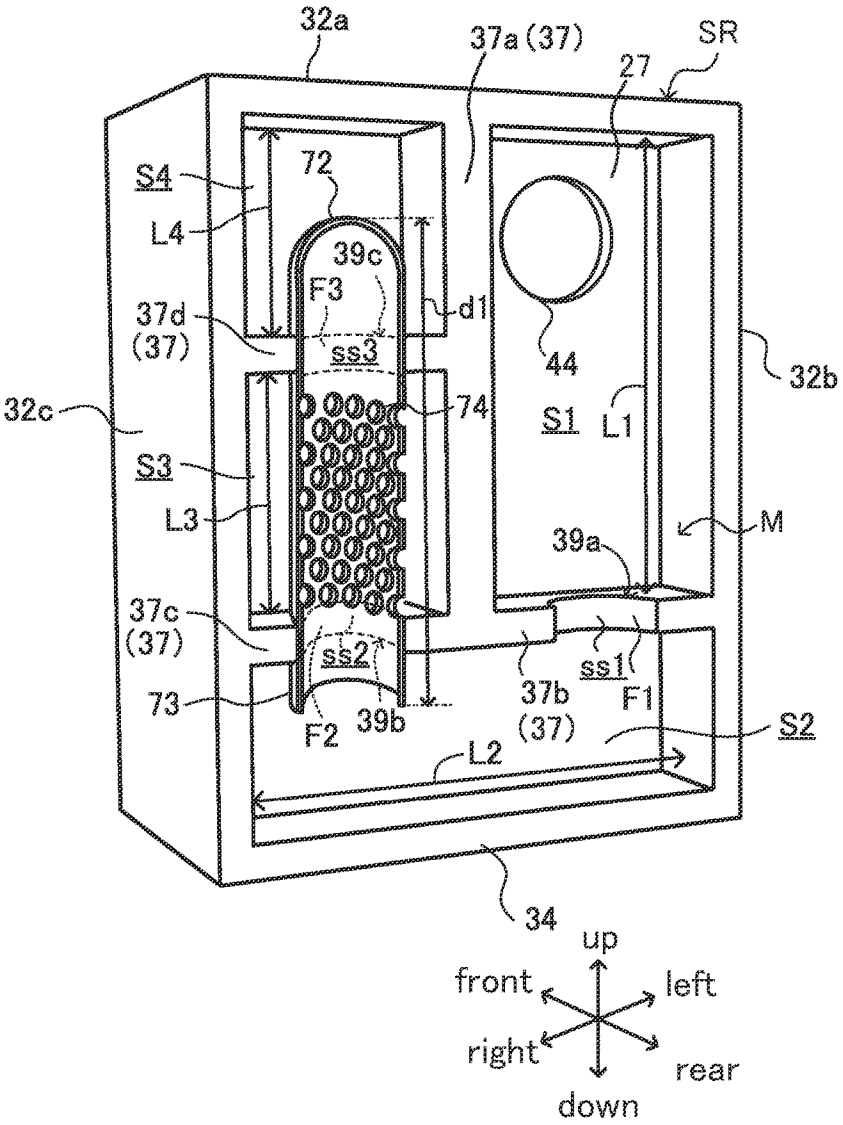
FIG. 4B is a three-dimensional perspective view in which a longitudinal section of a muffling chamber is illustrated.

With reference to FIG. 3, FIG. 4A, and FIG. 4B, a muffler structure (M) will be described. In FIG. 4A and FIG. 4B, a state in which a pipe (72), described later, is attached to the muffling chamber (SR) is illustrated. Note that hatching, which indicates cross-sections, is omitted in FIG. 4A and FIG. 4B.

The muffler structure (M) is formed at the muffling chamber (SR). The muffling chamber (SR) is disposed at the discharge flow path (38) between the discharge port (26) and the inflow end of the discharge pipe (8). The muffler structure (M) includes a first muffler portion (51) and a second muffler portion (S2). The first muffler portion (51) and the second muffler portion (S2) are connected in series such that a refrigerant gas repeats expansion and contraction. Details of the first muffler portion (51) and the second muffler portion (S2) will be described later.

The muffling chamber (SR) is formed between the cover body (32) and the bearing holder (27). Specifically, the muffling chamber (SR) is formed in the discharge space (36). The muffling chamber (SR) has an inflow port (44), the outflow port (45), and a division wall (37).

The inflow port (44) is formed in the bearing holder (27). The inflow port (44) is disposed at a left upper portion of the bearing holder (27). The refrigerant discharged through the discharge port (26) of the compression mechanism (20) flows through the inflow port (44) into the muffling chamber (SR).

The outflow port (45) is formed in the cover portion (31). The outflow port (45) is disposed in a right upper portion of the back wall (32*e*) of the cover portion (31). The outflow port (45) is in communication with the discharge flow path (38). The refrigerant in the muffling chamber (SR) flows out through the outflow port (45) to the discharge flow path (38).

The division wall (37) includes a main division wall (37*a*), a first division wall (37*b*), a second division wall (37*c*), and a third division wall (37*d*). Each division wall (37) is integral with the cover body (32). In a state in which the bearing holder (27) is attached to the cover body (32), the front end portion of each division wall (37) is in close contact with the bearing holder (27).

The main division wall (37*a*) forms a first flow path (40) for the refrigerant gas that flows from the inflow port (44) toward the outflow port (45). Specifically, the main division wall (37*a*) extends from the upper wall (32*a*) toward the partition wall (34) so as to pass a portion between the inflow port (44) and the outflow port (45). Consequently, the first flow path (40) has a U-shape. More specifically, the first flow path (40) causes the refrigerant gas that has flowed in through the inflow port (44) to, after flowing downward in a left portion inside the muffling chamber (SR), flow upward in a right portion inside the muffling chamber (SR) and flow out through the outflow port (45) to the muffling chamber (SR).

The first flow path (40) has four spaces (S1 to S4). The four spaces (S1 to S4) are a first space (S1), a second space (S2), a third space (S3), and a fourth space (S4) that are arranged side by side in this order toward the flowing direction of the refrigerant. The first to fourth spaces (S1 to S4) are formed by the division wall (37). The first to third division walls (37*b* to 37*d*) are disposed such that the volumes of the first to fourth spaces (S1 to S4) differ from each other.

The first space (S1) is the first muffler portion (S1) in the present disclosure. The first space (S1) is formed at a position where the inflow port (44) is disposed in the first flow path (40). The first space (S1) is a space divided by the first division wall (37*b*) in the first flow path (40). Specifically, the first space (S1) is demarcated by the left side wall (32*b*), the main division wall (37*a*), the upper wall (32*a*), the first division wall (37*b*), the back wall (32*e*), and the bearing holder (27). The first division wall (37*b*) connects the left side wall (32*b*) and the main division wall (37*a*) to each other. The first division wall (37*b*) is disposed at the height position of the lower end of the main division wall (37*a*). The first space (S1) is a first expansion space (S1) in the present disclosure and the second space (S2) is a second expansion space (S2) in the present disclosure. The first division wall (37*b*) divides the first expansion space (S1) and the second expansion space (S2) from each other. The flow-path length of the flow path for the refrigerant gas in the first space (S1) is denoted by L1. L1 is a length between a surface of the upper wall (32*a*) and a surface of the first division wall (37*b*), the surfaces facing each other.

The first division wall (37*b*) has a first opening (39*a*). Through the first opening (39*a*), the first space (S1) and the second space (S2) are in communication with each other. The first opening (39*a*) is circular. The first opening (39*a*) is formed by a first inner peripheral surface (F1) formed at the first division wall (37*b*). A first small space (ss1) surrounded by the first inner peripheral surface (F1) is formed in the first division wall (37*b*).

The second space (S2) is the second muffler portion (S2) in the present disclosure. The second space (S2) is connected in series to the first space (S1). The second space (S2) is a space that is divided by the first division wall (37*b*) and the second division wall (37*c*) in the first flow path (40). Specifically, the second space (S2) is formed by the first division wall (37*b*), the second division wall (37*c*), the left side wall (32*b*), the right side wall (32*c*), the partition wall (34), the back wall (32*e*), and the bearing holder (27). The second division wall (37*c*) connects the right side wall (32*c*) and the main division wall (37*a*) to each other. The second division wall (37*c*) is disposed at the height position of the lower end of the main division wall (37*a*). The flow-path length of the flow path for the refrigerant gas in the second space (S2) is denoted by L2. L2 is a length between a surface of the left side wall (32*b*) and a surface of the right side wall (32*c*), the surfaces facing each other.

The second division wall (37*c*) has a second opening (39*b*). Through the second opening (39*b*), the second space (S2) and the third space (S3) are in communication with each other. The second opening (39*b*) is circular. The second opening (39*b*) is formed by a second inner peripheral surface (F2) formed at the second division wall (37*c*). A second small space (ss2) surrounded by the second inner peripheral surface (F2) is formed in the second division wall (37*c*).

The third space (S3) is a space divided by the second division wall (37*c*) and the third division wall (37*d*) in the first flow path (40). Specifically, the third space (S3) is demarcated by the second division wall (37*c*), the third division wall (37*d*), the main division wall (37*a*), the right side wall (32*c*), the back wall (32*e*), and the bearing holder (27). The third division wall (37*d*) connects the right side wall (32*c*) and the main division wall (37*a*) to each other. The third division wall (37*d*) is disposed at a position closer than the height position of an intermediate portion of the main division wall (37*a*) to the upper wall (32*a*). The flow-path length of the flow path for the refrigerant gas in the third space (S3) is denoted by L3. L3 is a length between a surface of the second division wall (37*c*) and a surface of the third division wall (37*d*), the surfaces facing each other.

The third division wall (37*d*) has a third opening (39*c*). Through the third opening (39*c*), the third space (S3) and the fourth space (S4) are in communication with each other. The third opening (39*c*) is circular. The third opening (39*c*) is formed by a third inner peripheral surface (F3) formed at the third division wall (37*d*). A third small space (ss3) surrounded by the third inner peripheral surface (F3) is formed in the third division wall (37*d*).

The fourth space (S4) is disposed at a position where the outflow port (45) is formed in the first flow path (40). The fourth space (S4) is a space that is divided by the third division wall (37*d*) in the first flow path (40). Specifically, the fourth space (S4) is demarcated by the third division wall (37*d*), the main division wall (37*a*), the right side wall (32*c*), the upper wall (32*a*), the back wall (32*e*), and the bearing holder (27). The flow-path length of the flow path for the refrigerant gas in the fourth space (S4) is denoted by L4. L4 is a length of a surface of the third division wall (37*d*) and a surface of the upper wall (32*a*), the surfaces facing each other.

The first division wall (37*b*) to the third division wall (37*d*) are disposed such that the flow-path lengths L1 to L4 differ from each other. Consequently, the volume of the first to fourth spaces (S1 to S4) differ from each other.

Pipe

A pipe (72) is provided at the muffling chamber (SR).

The pipe (72) has a cylindrical shape. The outer peripheral surface of the pipe (72) is fixed to the second opening (39*b*) (second inner peripheral surface (F2)) and the third opening (39*c*) (third inner peripheral surface (F3)). The inflow end of the pipe (72) is in communication with the second space (S2). The outflow end of the pipe (72) is connected to the outflow port (45). The length from the inflow end to the outflow end of the pipe is denoted by d1.

The pipe (72) includes an inner duct portion (73). The inner duct portion (73) is a portion of the pipe (72), the portion projecting downward from the second opening. The inflow end of the pipe is included in the inner duct portion (73). The length of the inner duct is denoted by d2.

The pipe (72) has a plurality of holes (74). The plurality of holes (74) are formed at a position corresponding to the third space (S3).

A muffling material is provided at the muffling chamber (SR). The muffling material is provided in the first space (S1), the second space (S2) and the third space (S3). The muffling material includes, for example, glass wool, steel wool, or a porous body.

Flow of Refrigerant Gas

The refrigerant gas discharged through the discharge port (26) of the compression mechanism (20) flows through the inflow port (44) into the muffling chamber (SR). The refrigerant gas that has flowed into the muffling chamber (SR) flows through the first space (S1), the first small space (ss1), the second space (S2), and the pipe (72) in this order. The refrigerant gas expands in the first space (S1), contracts in the first small space (ss1), and expands in the second space (S2). The refrigerant gas that has flowed from the first space (S1) into the pipe (72) flows out through the outflow port (45).

As described above, due to the first space (S1) and the second space (S2) being connected in series through the first small space (ss1), the refrigerant gas repeats expansion and contraction. The length of the muffler structure that includes the first space (S1) and the second space (S2) is, for example, 50 mm to 2000 mm. The flow-path length L1 in the first space (S1) and the flow-path length L2 in the second space are set such that the attenuation frequency of the refrigerant gas that flows in the muffler structure (M) is 3,000 Hz or less or the attenuation amount is 10 DB or more.

Reduction of Refrigerant Noise

In a compressor such as that in the present embodiment, a decompressed refrigerant having a high pressure generates pressure pulsations in a discharge pipe by flowing. Refrigerant noise is generated due to this pressure pulsations. Specifically, the pressure pulsations contain a frequency component that is determined by the product of the rotational speed of a screw rotor and the number of teeth of the screw rotor. A change in the rotational speed of the screw rotor generates a frequency component corresponding to the rotational speed. Therefore, pressure pulsations that contain a plurality of frequency components are generated in the discharge pipe.

Muffling structures that suppress generation of such refrigerant noise have been proposed. For example, a muffling device (muffler) is attached, outside a compressor, to a discharge pipe, or a muffling space is formed by processing a thick portion inside a compressor to suppress generation of refrigerant noise by resonance.

When a muffling device (muffler) is attached outside a compressor, however, a distance from a compression-chamber outlet to the muffling device is relatively long, and the refrigerant that flows in a pipe, an oil separator, and the like that are disposed between the compression-chamber outlet and the muffling device may generate noise. In addition, since the muffling device is connected outside the compressor, it is required to ensure a space for providing the muffling device. Further, forming a muffling space inside a compressor may lead to an increase in processing costs for forming the muffling space with design flexibility being relatively decreased, for example, forming the muffling space being basically impossible without a thick portion.

Considering these circumstances, the compressor (10) in the present embodiment includes the muffler structure (M) that is disposed at the discharge flow path (38) through which the compression-chamber outlet (26) of the compression mechanism (20) and the inflow end of the discharge pipe (8) are in communication with each other. The muffler structure (M) is the first space (S1) (first muffler portion) and the second space (S2) (second muffler portion) that are connected in series such that the refrigerant gas repeats expansion and contraction.

According to the present embodiment, as a result of the first space (S1) and the second space (S2) causing the refrigerant gas that flows in the first flow path (40) to repeat expansion and contraction multiple times, it is possible to reduce pulsations of refrigerant noise. The first space (S1) and the second space (S2), which are each the muffler structure (M), are disposed between the discharge port (26) inside the compressor (10) and the inflow end of the discharge pipe (8). Therefore, the pressure pulsations of the refrigerant gas discharged through the discharge port (26) can be attenuated on a relatively upstream side, and it is consequently possible to improve the effect of reducing the pulsations. In addition, since the pressure pulsations of the refrigerant gas can be attenuated on the relatively upstream side by the muffler structure (M), it is possible to suppress a situation in which a member provided downstream the muffler structure (M) is excited.

The muffler structure (M) of the compressor (10) in the present embodiment is provided at a position closer than the inflow end of the discharge pipe (8) in the discharge flow path (38) to the discharge port (26).

According to the present embodiment, the discharge port (26) and the inflow port (44) of the muffling chamber (SR) are positioned relatively close to each other, and the first space (S1) is formed at the inflow port (44) of the muffling chamber (SR). Therefore, the compressed refrigerant gas having a high pressure flows into the muffling chamber (SR) immediately after being discharged through the discharge port (26), and a muffling effect is exerted by the muffler structure (M). Consequently, pressure pulsations of refrigerant noise can be suppressed on the further upstream side. In particular, in the present example, due to the discharge port (26) and the muffler structure (M) being directly connected to each other, the first wavelength of the pressure pulsations can be suppressed, and as a result, the effect of reducing the pulsation can be improved. The pressure pulsations here include a pressure pulsation in which the product of the number of grooves of the compression mechanism (20) and the operation frequency is a primary component.

With the muffler structure (M) of the compressor (10) in the present embodiment, the attenuation frequency of the refrigerant gas is 3000 Hz or less or the attenuation amount is 10 DB or more. In the present example, by adjusting the position of the first division wall (37*b*) provided at the cover portion (31), it is possible to easily change the lengths L1 and L2. In addition, by simply changing the opening area of the first small space (ss1), it is possible to adjust the flow rate of the refrigerant gas and the muffling effect to an intended flow rate and an intended muffling effect. As described above, by changing the position of the first division wall (37*b*) and the opening area of the first small space (ss1), it is possible to achieve the muffler structure (M) that is high in design flexibility.

The muffler structure (M) of the compressor (10) in the present embodiment has the first space (S1) (first expansion space) and the second space (S2) (second expansion space) that differ from each other in volume. The first space (S1) is the first muffler portion (S1), and the second space (S2) is the second muffler portion (S2). Consequently, it is possible in the first space (S1) and the second space (S2) to attenuate the wavelengths of the refrigerant noise in different frequency bands. As a result, it is possible to increase the effect of reducing refrigerant noise.

The compressor (10) in the present embodiment includes the concave-shaped cover portion (31) that is attached to the casing (11) so as to cover the opening (11*a*) of the casing (11) and that forms the muffling chamber (SR) between the cover portion (31) and the bearing holder (27) (plate portion). The muffler structure (M) is provided at the muffling chamber (SR).

According to the present embodiment, the muffling chamber (SR) is formed in a closed space between the bearing holder (27) and the cover portion (31). Since the concave portion of the cover portion (31) is a dead space, it is possible by providing the muffler structure (M) in such a space to effectively use the space inside the compressor (10). Consequently, while it is required, for example, when the muffler structure (M) is provided outside the compressor (10) to install the compressor (10) and the muffler structure (M) separately, it is possible in the compressor (10) of the present disclosure to address space saving at the installation location of the compressor (10) since the muffler structure (M) is disposed inside the compressor (10).

In the compressor (10) in the present embodiment, the first space (S1) (first expansion space) and the second space (second expansion space) are formed by the division wall (37) provided in the muffling chamber (SR). Consequently, it is possible to form the first space (S1) and the second space (S2) simply and possible to address cost saving without the need to, for example, newly provide a muffling device. In addition, by simply adjusting the position where the division wall is formed, it is possible to cause a desired noise reduction effect to be exerted.

In the compressor (10) in the present embodiment, the division wall (37) is integral with the cover portion (31). Consequently, it is possible to form the muffler structure (M)

relatively easily by simply attaching the cover portion (31) integral with the division wall (37) to the plate portion (27).

In the compressor (10) in the present embodiment, the division wall (37) includes the first division wall (37*b*) that divides the first space (S1) and the second space (S2) from each other. The first division wall (37*b*) has the first opening (39*a*) through which the first space (S1) and the second space (S2) are in communication with each other. Consequently, it is possible to form the first space (S1) and the second space (S2) relatively easily by simply providing the first division wall (37*b*).

The compressor (10) in the present embodiment further includes the pipe (72) that is connected to the outflow end of the muffler structure (M) and that is in communication with the inflow end of the discharge pipe (8). An intended frequency band can be set by the length d1 of the pipe (72). Consequently, it is possible to reduce the refrigerant noise in a desired frequency band. In particular, by setting the length d1 of the pipe in accordance with the length L1 of the first space (S1) and the length L2 of the second space (S2), it is possible to cause a relatively high noise reduction effect to be exerted.

In addition, the pipe (72) has the plurality of holes (74). The plurality of holes (74) are formed at a position corresponding to the closed third space (S3). Consequently, when the refrigerant gas flows in the pipe (72), refrigerant noise can be reduced by resonance generated due to the plurality of holes (74). Refrigerant noise of the refrigerant that passes through the formed pipe (72) can be suppressed.

In addition, the inner duct portion (73) is formed at the pipe (72) in the present example. By setting the length d2 of the inner duct portion (73), as appropriate, it is possible to cause a relatively high noise reduction effect to be exerted.

In the compressor (10) in the present embodiment, the flow-path length of the muffler structure (M) is 50 mm to 2000 mm. Consequently, it is possible to suppress the wavelengths of 75 Hz to 3000 Hz.

In the compressor (10) in the present embodiment, the muffling material is provided at the inner wall of each of the first muffler portion (S1) and the second muffler portion (S2). Specifically, the muffling material is bonded to the inner wall of each of the first to third expansion spaces (S1 to S3) and the first and second small spaces (ss1 and ss2). Consequently, it is possible to further increase the effect of reducing refrigerant noise.

Modification 1

Figure 5A:
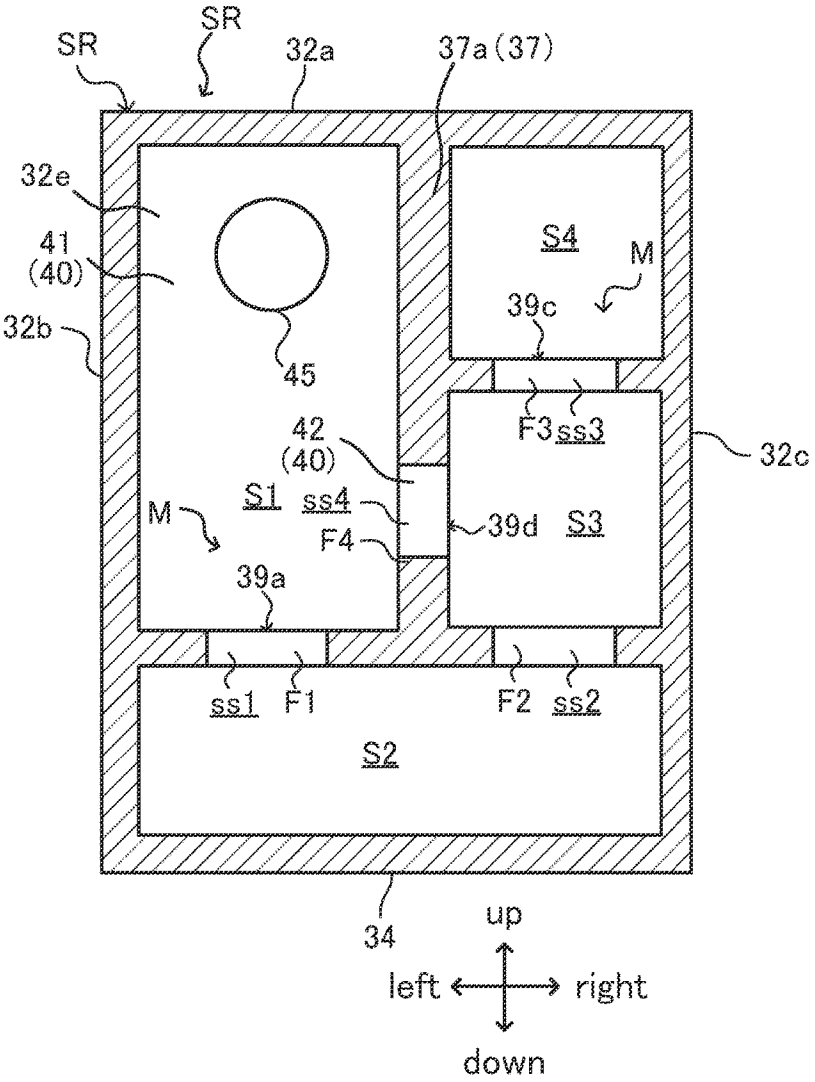
FIG. 5A is a longitudinal sectional view of a muffling chamber according to Modification 1.
Figure 5B:
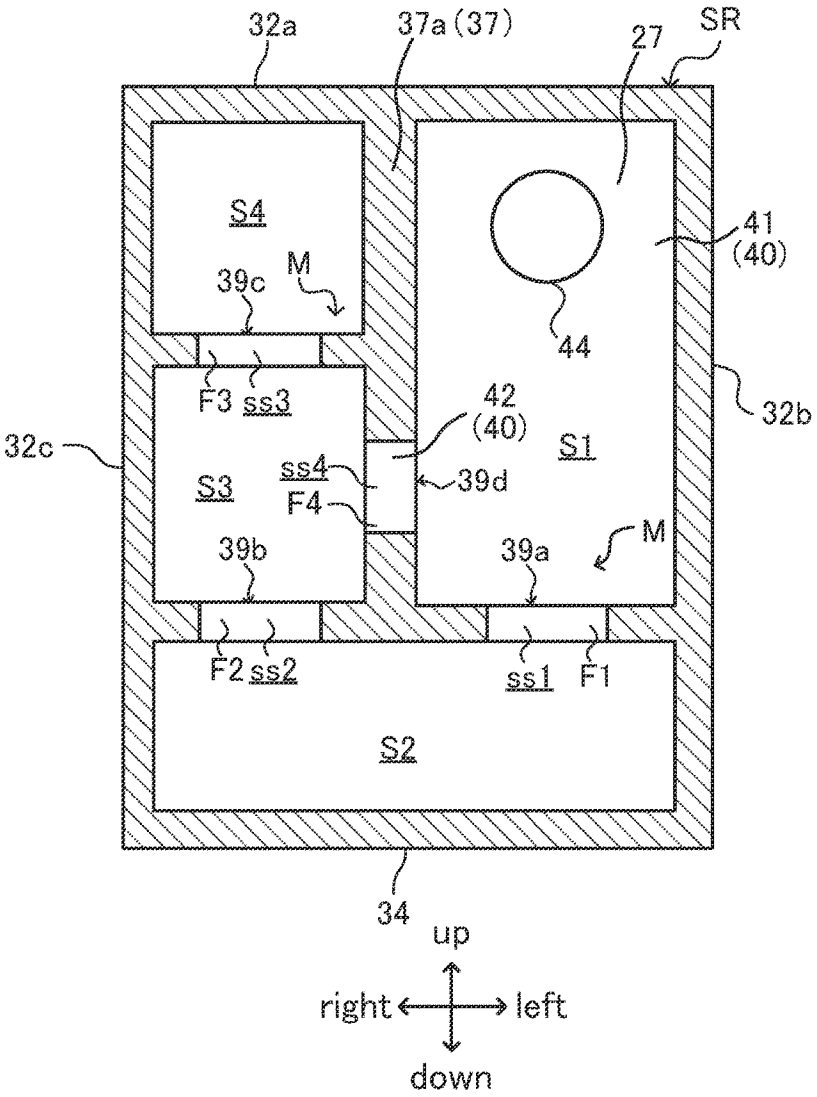
FIG. 5B is a longitudinal sectional view of a muffling chamber according to Modification 1.

With reference to FIG. 5A and FIG. 5B, the compressor (10) according to Modification 1 will be described. Hereinafter, configurations that differ from those in the compressor (10) in the aforementioned embodiment will be described.

In the present modification, the pipe (72) is not provided at the muffling chamber (SR). The main division wall (37*a*) has a fourth opening (39*d*) through which the first space (S1) and the third space (S3) are in communication with each other. The fourth opening (39*d*) is circular. The main division wall (37*a*) has a fourth inner peripheral surface (F4) in which the fourth opening (39*d*) is formed. A fourth small space (ss4) surrounded by the fourth inner peripheral surface (F4) is formed in the main division wall (37*a*). The first flow path (40) in the present modification includes the main flow path (41) and an auxiliary flow path (42).

The main flow path (41) is a flow path along which the refrigerant gas flows through the first space (S1), the first small space (ss1), the second space (S2), the second small space (ss2), the third space (S3), the third small space (ss3), and the fourth space (S4) in this order.

The auxiliary flow path (42) is a flow path along which the refrigerant gas that flows from the inflow port (44) toward the outflow port (45) joins the main flow path (41) after branching from the main flow path (41). Specifically, the auxiliary flow path (42) is the fourth small space (ss4) through which the first space (S1) and the third space (S3) are in communication with each other.

Flow of Refrigerant Gas

A portion of the refrigerant gas that passes through the first space (S1) after flowing in through the inflow port (44) flows through the first small space (ss1), the second space (S2), the second small space (ss2), the third space (S3), the third small space (ss3), and the fourth space (S4) in this order, thereby repeating expansion and contraction. The rest of the refrigerant gas that passes through the first space (S1) flows through the fourth small space (ss4), the third space (S3), the third small space (ss3), and the fourth space (S4) in this order, thereby repeating expansion and contraction.

As described above, in the muffling chamber (SR) in the present modification, the flow-path length from the inflow port (44) to the outflow port (45) is different between when the refrigerant gas flows in the main flow path (41) and when the refrigerant gas flows in the auxiliary flow path (42). In the muffling chamber (SR) in the present modification, refrigerant noise having various frequencies can be reduced since the refrigerant-gas flow paths having different flow-path lengths are provided.

Modification 2

Figure 6A:
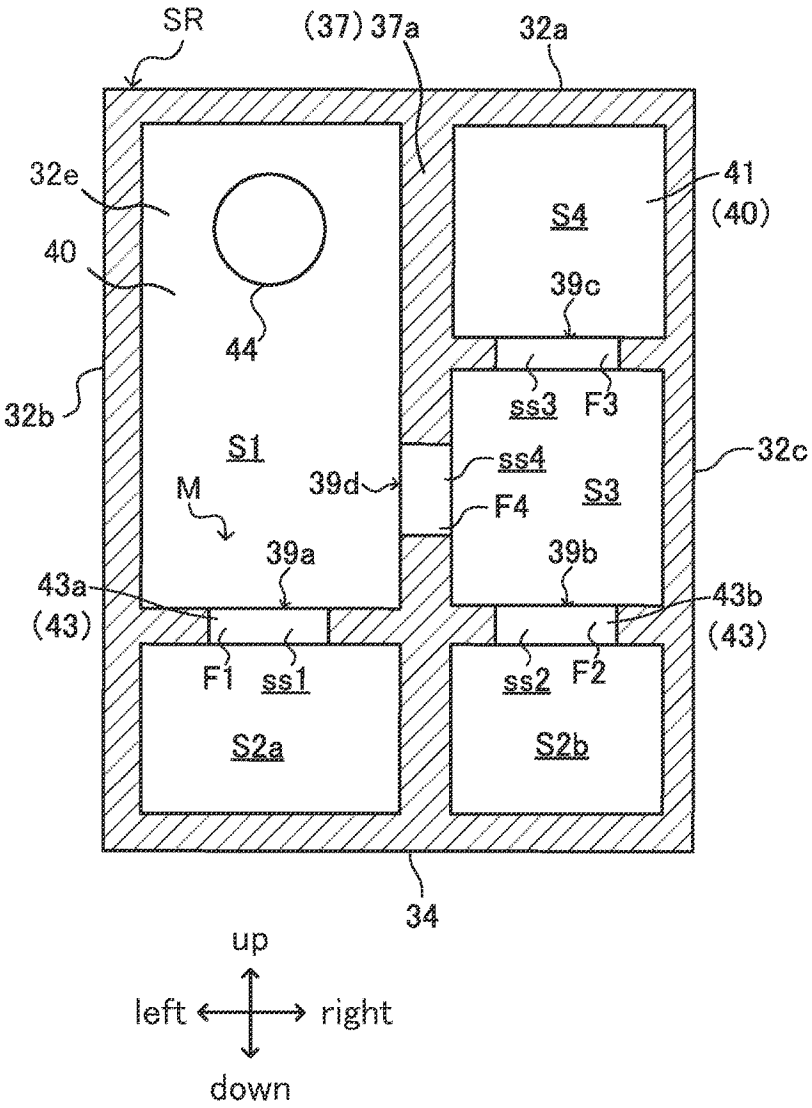
FIG. 6A is a longitudinal sectional view of a muffling chamber according to Modification 2.
Figure 6B:
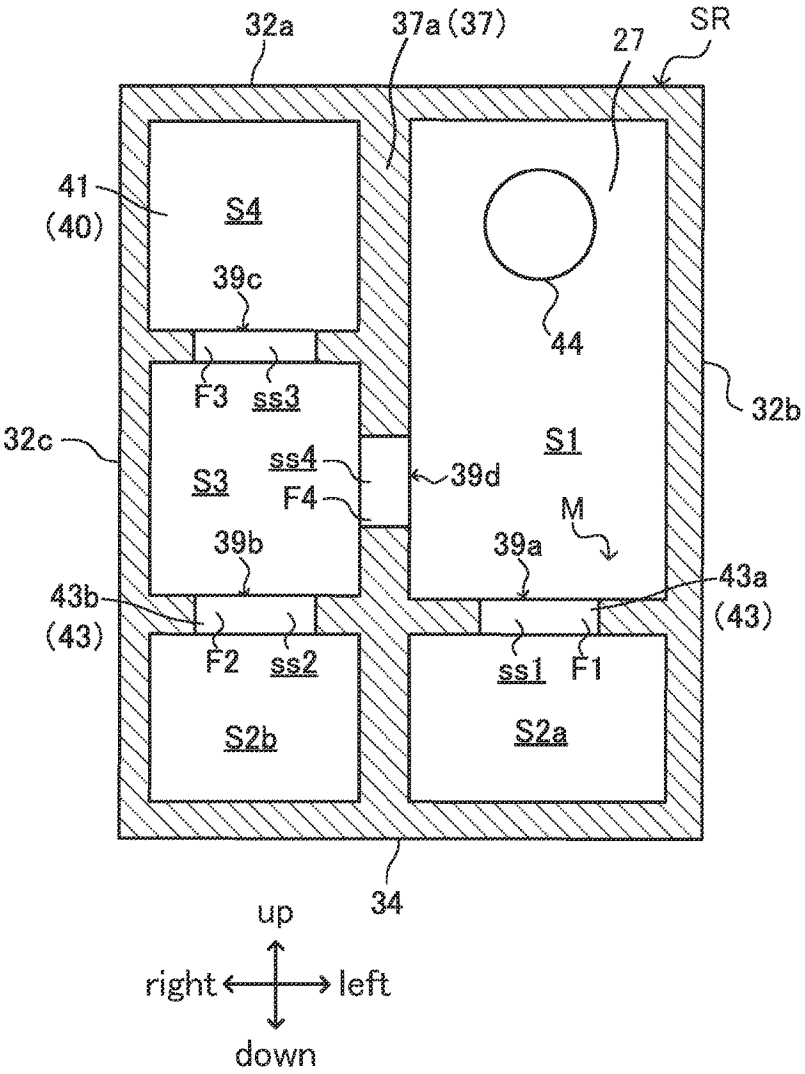
FIG. 6B is a longitudinal sectional view of a muffling chamber according to Modification 2.

With reference to FIG. 6A and FIG. 6B, the compressor (10) according to Modification 2 will be described. Hereinafter, configurations that differ from those in the compressor (10) in Modification 1 described above will be described.

The muffling chamber (SR) in the present modification has a fourth division wall (37*e*). The fourth division wall (37*e*) is formed to extend from the lower end of the main division wall (37*a*) to the partition wall (34). The fourth division wall (37*e*) divides the second space (S2) into two spaces in the left-right direction. A left portion of the second space (S2) divided by the fourth division wall (37*e*) is referred to as a left second space (S2*a*), and a right portion of the second space (S2) divided by the fourth division wall (37*e*) is referred to as a right second space (S2*b*). The volume of the left second space (S2*a*) and the volume of the right second space (S2*b*) differ from each other. The first flow path (40) in the present modification includes the main flow path (41) and a branch flow path (43).

The main flow path (41) is a flow path along which the refrigerant gas flows through the first space (S1), the fourth small space (ss4), the third space (S3), the third small space (ss3), and the fourth space (S4) in this order.

The branch flow path (43) is a flow path branching from the main flow path (41). The outflow end of the branch flow path (43) is closed. The branch flow path (43) in the present modification includes a first branch flow path (43*a*) and a second branch flow path (43*b*). The first branch flow path (43*a*) is constituted by the first small space (ss1) and the left second space (S2*a*). The second branch flow path (43*b*) is constituted by the second small space (ss2) and the right second space (S2*b*).

Flow of Refrigerant Gas

The refrigerant gas that has flowed through the inflow port (44) into the muffling chamber (SR) flows through the first space (S1), the fourth small space (ss4), the third space (S3), the third small space (ss3), and the fourth space (S4) in this order, thereby repeating expansion and contraction. The first branch flow path (43*a*) and the second branch flow path (43*b*) block propagation of acoustic waves having frequencies in the vicinity of the frequency of acoustic resonance. Consequently, in the refrigerant noise generated by the refrigerant gas that flows in the main flow path (41), refrigerant noise having a frequency that is the same as the frequency of the resonance can be suppressed. As described above, it is possible in the present modification by providing the branch flow path (43) at the muffling chamber (SR) to improve the effect of attenuating refrigerant noise.

Other Embodiments

The aforementioned embodiment may be configured as follows.

The attenuation frequency of the refrigerant gas may be 2000 Hz or less or the attenuation amount may be 20 DB or more with the muffler structure (M).

Figure 7A:
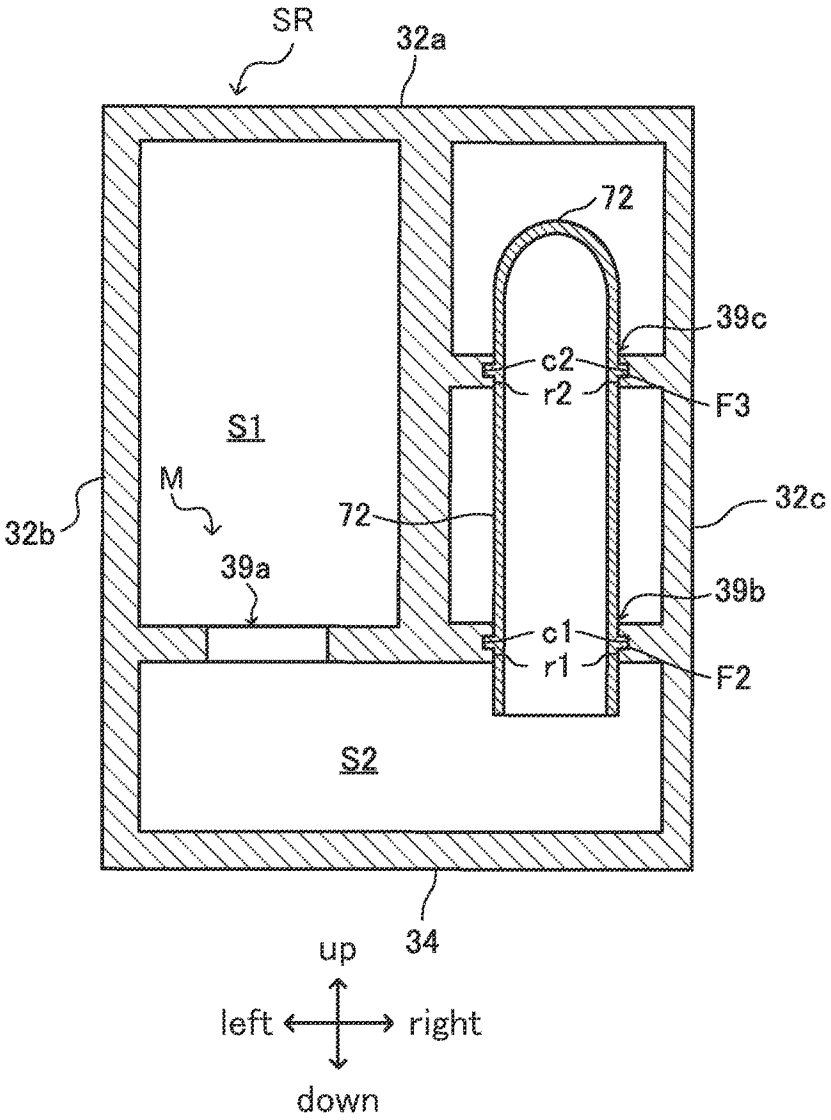
FIG. 7A is a longitudinal sectional view of a muffling chamber according to a different embodiment.
Figure 7B:
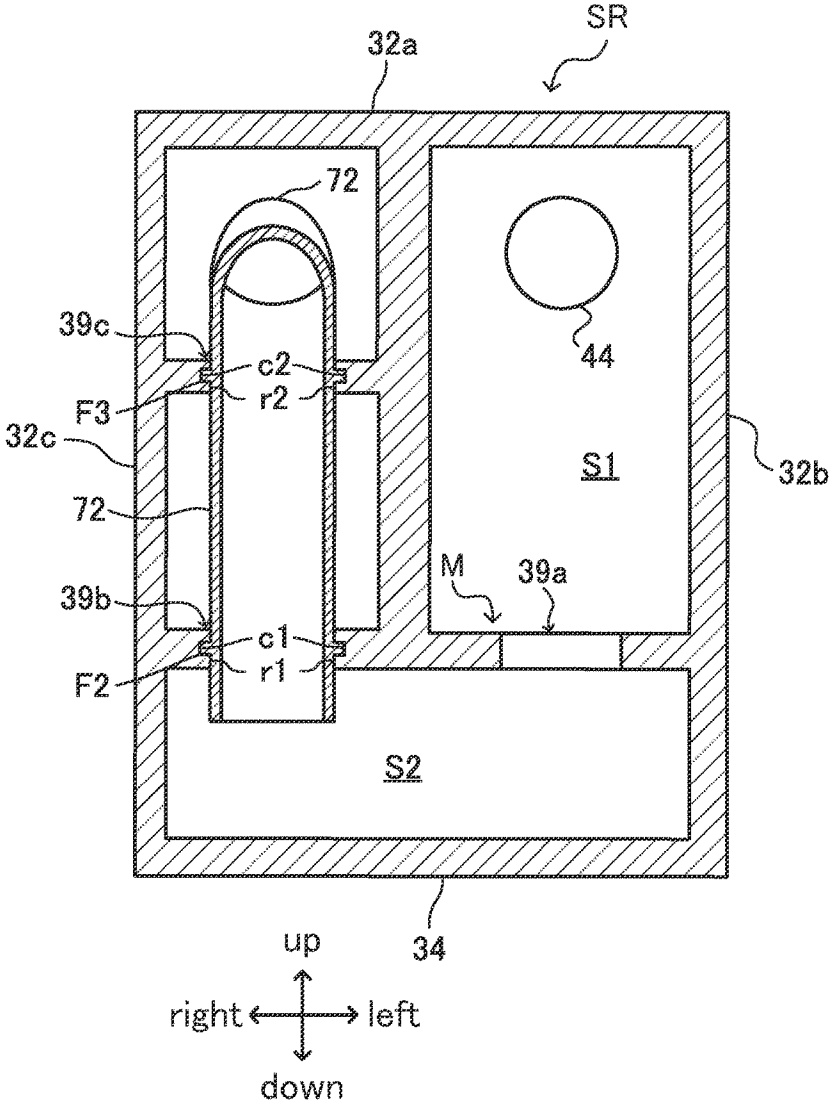
FIG. 7B is a longitudinal sectional view of a muffling chamber according to another different embodiment.

As illustrated in FIG. 7A and FIG. 7B, the pipe (72) may be fixed by being fitted into the second opening (39*b*) and the third opening (39*c*). Specifically, the second opening (39*b*) includes a first concave portion (r1) formed in the circumferential direction of the second inner peripheral surface (F2). The third opening (39*c*) includes a second concave portion (r2) formed in the circumferential direction of the third inner peripheral surface (F3). A first protruding portion (c1) and a second protruding portion (c2) are formed in the circumferential direction on the outer peripheral surface of the pipe (72). The first protruding portion (c1) of the pipe is fitted into the first concave portion (r1) of the second opening, the second protruding portion (c2) is fitted into the second concave portion (r2) of the third opening, and the pipe (72) is thereby fixed to the second opening (39*b*) and the third opening (39*c*). Consequently, it is possible to suppress a situation in which the pipe (72) is displaced inside the muffling chamber (SR).

The pipe (72) in the aforementioned embodiment may be not necessarily provided with a large number of the holes (74).

The inner duct portion (73) may be not necessarily provided at the pipe (72) in the aforementioned embodiment. The inner duct portion (73) may be provided so as to protrude from the first opening (39*a*) toward the second space (S2).

In the aforementioned embodiment, the pipe (72) may be not necessarily included in the muffler structure (M). In this case, the first flow path (40) is a flow path along which the refrigerant gas flows through the first space (S1), the first small space (ss1), the second space (S2), the second small space (ss2), the third space (S3), the third small space (ss3), and the fourth space (S4) in this order. Consequently, it is possible to increase the number of repeats of expansion and contraction in the first flow path (40) and possible due to the flow-path lengths (L1 to L4) of the first to fourth spaces (S1 to S4) differing from each other to improve the noise reduction effect.

In the aforementioned embodiment, as long as the muffler structure (M) is configured such that the refrigerant gas that flows inside the muffling chamber (SR) repeats expansion and contraction multiple times, the number and the shape of the division wall (37) are not limited. For example, a division wall may be provided inside the first flow path (40) in addition to the first to third division wall (37*b* to 37*d*). The main division wall (37*a*) may be not formed such that the flow of the refrigerant gas flows in a U-shape.

The division wall (37) may be formed at the bearing holder (27) or may be formed at both the bearing holder (27) and the cover portion (31). When the division wall (37) is formed at both the bearing holder (27) and the cover portion (31), a portion of each division wall (37) is formed at the bearing holder (27) and the rest of each division wall is formed at the cover portion (31). Each division wall (37) is formed by attaching the cover portion (31) to the bearing holder (27).

In the aforementioned embodiment, the pipe (72) may be provided in the first space (S1). In this case, the inflow end of the pipe (72) is connected to the inflow port (44). The outflow end of the pipe (72) is in communication with the second space (S2). The outer peripheral surface of the pipe (72) is fixed to the first inner peripheral surface (F1) (first opening (39*a*)). The refrigerant gas discharged through the discharge port (26) flows through the pipe (72), the second space (S2), the second small space (ss2), the third space (S3), the third small space (ss3), and the fourth space (S4) in this order. Also in this case, the refrigerant gas repeats contraction and expansion multiple times, and refrigerant noise can be reduced.

While embodiments and modifications have been described above, it should be understood that various changes in forms and details are possible without deviating from the gist and the scope of the claims. The embodiments and the modifications above may be combined together or replaced, as appropriate, as long as intended functions of the present disclosure are maintained. The phrases such as 'first', 'second', and the like used above are used to distinguish the nouns to which these phrases are applied from each other, and these phrases are not intended to limit the number and the order of the nouns.

As described above, the present disclosure is useful for a compressor.

The invention claimed is:

1. A compressor comprising:

a compression mechanism;

a muffler structure disposed between a compression-chamber outlet of the compression mechanism and an inflow end of a discharge pipe;

a casing having an opening on a discharge side of the compressor:

a plate portion disposed inside the casing, the plate portion being configured to hold a shaft end of a drive shaft provided inside the compressor;

a cover portion attached to the casing to cover the opening, the cover portion forming a muffling chamber between the cover portion and the plate portion, and the muffler structure being provided at the muffling chamber; and an oil separator body having a cylindrical body portion with an oil separation space formed therein, the cover portion being integral with the cylindrical body portion at a compression mechanism side of the cylindrical body portion, the muffler structure including a first muffler portion and a second muffler portion connected in series the muffler structure having a first expansion space and a second expansion space that differ from each other in volume, the first expansion space being the first muffler portion, and the second expansion space being the second muffler portion.

2. The compressor according to claim 1, wherein the muffler structure is provided, between the compression-chamber outlet and the inflow end of the discharge pipe, at a position closer to the compression-chamber outlet than to the inflow end of the discharge pipe.

3. The compressor according to claim 1, wherein an attenuation frequency of a refrigerant gas flowing in the muffler structure is no more than 3000 Hz or has an attenuation amount of at least 10 DB.

4. The compressor according to claim 1, wherein an attenuation frequency of a refrigerant gas flowing in the muffler structure is no more than 2000 Hz or has an attenuation amount of at least 20 DB.

5. The compressor according to claim 1, wherein the first expansion space and the second expansion space are formed by a division wall provided at the muffling chamber.

6. The compressor according to claim 5, wherein the division wall is integral with the cover portion.

7. The compressor according to claim 6, wherein the division wall includes a first division wall configured to divide the first expansion space and the second expansion space from each other, and the first division wall has an opening through which the first expansion space and the second expansion space are in communication with each other.

8. The compressor according to claim 7, further comprising:

a pipe connected to an outflow end of the muffler structure, the pipe being in communication with the inflow end of the discharge pipe.

9. The compressor according to claim 1, wherein the muffler structure includes a main flow path along which a refrigerant gas circulates through the first muffler portion and the second muffler portion, and an auxiliary flow path along which the refrigerant gas joins the main flow path after branching from the main flow path.

10. The compressor according to claim 1, wherein the muffler structure includes a main flow path along which a refrigerant gas circulates through the first muffler portion and the second muffler portion, and a branch flow path branching from the main flow path, the branch flow path having a closed outflow end.

11. The compressor according to claim 1, wherein the muffler structure has a flow-path length of 50 mm to 2000 mm.

12. The compressor according to claim 1, further comprising:

a muffling material provided at an inner wall of the first muffler portion or the second muffler portion.

* * * * *